US010221025B2

(12) United States Patent
Shimizu

(10) Patent No.: US 10,221,025 B2
(45) **Date of Patent: *Mar. 5, 2019**

(54) CONVEYANCE APPARATUS AND IMAGE RECORDING APPARATUS

(71) Applicant: BROTHER KOGYO KABUSHIKI KAISHA, Nagoya-shi, Aichi-ken (JP)

(72) Inventor: Yoshikazu Shimizu, Kasugai (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/809,264

(22) Filed: Nov. 10, 2017

(65) Prior Publication Data

US 2018/0079610 A1 Mar. 22, 2018

Related U.S. Application Data

(63) Continuation of application No. 15/275,906, filed on Sep. 26, 2016, now Pat. No. 9,815,645, which is a (Continued)

(30) Foreign Application Priority Data

Mar. 10, 2014 (JP) ..... 2014-046404

(51) Int. Cl.
*B65H 3/06* (2006.01)
*B65H 5/06* (2006.01)
*B65H 29/58* (2006.01)

(52) U.S. Cl.
CPC ..... *B65H 3/0669* (2013.01); *B65H 3/0684* (2013.01); *B65H 5/06* (2013.01); (Continued)

(58) Field of Classification Search
CPC ..... B65H 3/02; B65H 3/06; B65H 3/0607; B65H 2403/40; B65H 2403/48; (Continued)

(56) References Cited

U.S. PATENT DOCUMENTS 4,888,617 A 12/1989 Okuzawa
5,228,673 A 7/1993 Osonoe
5,897,112 A 4/1999 Kwag
8,297,612 B2 10/2012 Chapman et al.
(Continued)

FOREIGN PATENT DOCUMENTS

JP 2000-302260 A 10/2000
JP 3074028 U 12/2000
(Continued)

OTHER PUBLICATIONS

Notice of Reasons for Rejection of Japanese Patent Application No. 2017-092223, dated Feb. 27, 2018 with English translation, 5 pages.

*Primary Examiner* — David H Bollinger
(74) *Attorney, Agent, or Firm* — Merchant & Gould P.C.

(57) ABSTRACT

There is provided a conveyance apparatus including: a main body including a drive source, and a conveyance portion to which a drive force is transmitted from the drive source; an equipped unit including a drive portion to which the drive force is transmitted from the drive source in the main body; a first gear provided in the main body and rotated by the drive force transmitted thereto from the drive force; a first gear holder provided swingably in the main body to support the first gear; a second gear provided in the equipped unit to transmit the drive force to the drive portion; a second gear holder provided swingably in the equipped unit to support the second gear; and a third gear supported by a connecting shaft connecting the first and second gear holders to engage respectively with the first and second gears.

11 Claims, 13 Drawing Sheets

Related U.S. Application Data continuation of application No. 14/643,399, filed on Mar. 10, 2015, now Pat. No. 9,452,903.

(52) U.S. Cl.
CPC ..... *B65H 5/062* (2013.01); *B65H 29/58* (2013.01); *B65H 2402/35* (2013.01); *B65H 2402/46* (2013.01); *B65H 2403/42* (2013.01); *B65H 2404/6111* (2013.01); *B65H 2405/324* (2013.01); *B65H 2405/3322* (2013.01); *B65H 2601/523* (2013.01); *B65H 2801/06* (2013.01)

(58) Field of Classification Search
CPC .. B65H 2403/50; B65H 3/0669; B65H 5/062; B65H 2403/42; F16H 35/06
See application file for complete search history.

(56) References Cited

U.S. PATENT DOCUMENTS

| | | | | |
|---|---|---|---|---|
| 9,452,903 | B2 | 9/2016 | Shimizu | |
| 9,815,645 | B2 * | 11/2017 | Shimizu | B65H 3/0669 |
| 2002/0054381 | A1 | 5/2002 | Iwase | |
| 2005/0184448 | A1 | 8/2005 | Aoyagi et al. | |
| 2006/0180986 | A1 | 8/2006 | Hattori | |
| 2012/0104680 | A1 | 5/2012 | Blair et al. | |
| 2012/0193863 | A1 | 8/2012 | Harada | |

FOREIGN PATENT DOCUMENTS

| | | | |
|---|---|---|---|
| JP | 2001-19189 | A | 1/2001 |
| JP | 2001-191607 | A | 7/2001 |
| JP | 2002-060068 | A | 2/2002 |

* cited by examiner

CONVEYANCE APPARATUS AND IMAGE RECORDING APPARATUS

CROSS REFERENCE TO RELATED APPLICATION

The present application is a continuation of U.S. patent application Ser. No. 15/275,906, filed Sep. 26, 2016, which is a continuation of U.S. patent application Ser. No. 14/643,399, filed Mar. 10, 2015, which was granted on Sep. 27, 2016 as U.S. Pat. No. 9,452,903, which further claims priority from Japanese Patent Application No. 2014-046404 filed on Mar. 10, 2014 the disclosure of both of which are incorporated herein by reference in their entirety.

BACKGROUND

Field of the Invention

The present invention relates to a conveyance apparatus with an equipped unit assembled on its main body, and an image recording apparatus including the conveyance apparatus.

Description of the Related Art

Conventionally, there are known conveyance apparatuses with an equipped unit such as a sheet tray or the like assembled on their main body having a conveyance portion to transport recording sheets. The sheet tray or the like has a drive portion such as a feed roller or the like to convey the sheets to the conveyance portion. A drive force is transmitted from a motor provided in the main body to the feed roller or the like to drive the same.

It is common to use a gear train to construct a mechanism for transmitting the drive force from a drive source in the main body to the drive portion of the equipped unit. However, for example, there may be variation in assembling the main body and the equipped unit. Further, it is possible that an excessive load arises in driving the equipped unit such that the equipped unit deviates in relative position to the extent of a looseness between itself and the main body, and/or there is variation in the relation of relative position between the main body and the equipped unit depending on a swinging position of the equipped unit with respect to the main body. In such cases, there is variation in pitches between the gears. Due to such variation in the pitches between the gears, each of the gears forming the gear train is liable to unsmooth rotation, or to break its teeth.

SUMMARY

The present teaching has been made to solve the foregoing problems, and an object thereof is to provide a mechanism capable of keeping constant pitches in the gear train or gear array for transmitting the drive force from the drive source in the main body to the drive portion of the equipped unit.

According to an aspect of the present teaching, there is provided a conveyance apparatus configured to transport recording sheets, the apparatus including:

a main body including a drive source, and a conveyance portion to which a drive force is transmitted from the drive source and which is configured to convey the sheets;

an equipped unit being equipped to the main body and including a drive portion to which the drive force is transmitted from the drive source in the main body;

a first gear provided in the main body and rotated by the drive force transmitted thereto from the drive force;

a first gear holder provided swingably in the main body to support the first gear;

a second gear provided in the equipped unit to transmit the drive force to the drive portion;

a second gear holder provided swingably in the equipped unit to support the second gear; and a third gear supported by a connecting shaft connecting the first gear holder and the second gear holder to engage respectively with the first gear and the second gear.

The first gear holder keeps a constant pitch between the first gear and the third gear, while the second gear holder keeps a constant pitch between the second gear and the third gear. Further, the first gear holder and the second gear holder are swingably connected with each other by the connecting shaft supporting the third gear. By virtue of this, even when at least one of the first gear holder and the second gear holder swings, as to the first gear, third gear and second gear, the pitches between the respective gears are still kept constant.

The present teaching may also be apprehended as an image recording apparatus including the above conveyance apparatus, and a recording portion adapted to record images on any of the sheets conveyed by the above conveyance portion.

According to the present teaching, even when there is variation in the relation of relative position between the main body and the equipped unit, it is still possible to keep the constant pitches in the gear train for transmitting the drive force from the drive source in the main body to the drive portion of the equipped unit.

DESCRIPTION OF THE EMBODIMENT

Figure 1:
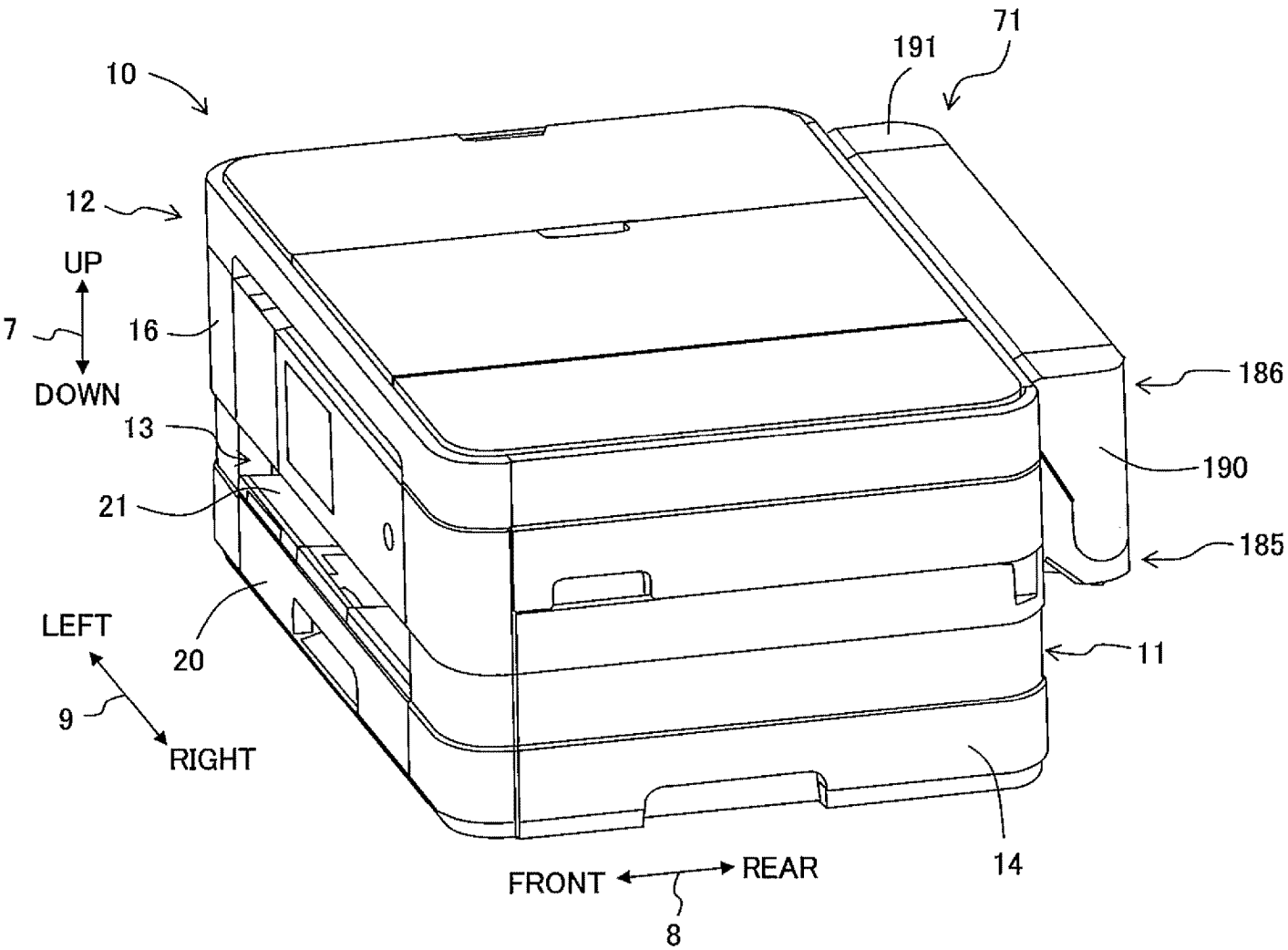
FIG. 1 is a perspective external view of a multifunction peripheral 10 in which a movable portion 186 is in an upstanding state.

An explanation will be made on a multifunction peripheral 10 according to an embodiment of the present teaching. Further, it is needless to say that the embodiment to be explained below is merely an example of the present teaching, and it is possible to appropriately change the embodiment of the present teaching without departing from the gist and scope of the present teaching. Further, in the following explanation, an up-down direction 7 is defined on the basis of such a state that the multifunction peripheral 10 is placed to be usable (a state depicted in FIG. 1); a front-rear direction 8 is defined as an opening 13 is provided on the near side (the front side); and a left-right direction 9 is defined as the multifunction peripheral 10 is viewed from the near side (the front side).

<Entire Structure of the Multifunction Peripheral 10>

As depicted in FIG. 1, the multifunction peripheral 10 is formed to have an approximately cuboid form, and the multifunction peripheral 10 includes a printer portion 11 of an ink-jet recording system to record images on a sheet of recording paper or the like. The multifunction peripheral 10 includes various functions such as a facsimile function, a print function, and the like.

The printer portion 11 has a casing or housing body 14 with the opening 13 formed in its front surface. A feed tray 20 on which the recording paper in various sizes can be stacked and a discharge tray 21 are inserted from the opening 13 in the front-rear direction 8. Further, the feed tray 20 and the discharge tray 21 are removable from the opening 13. The bottom surface of the casing 14 abuts against a surface on which the multifunction peripheral 10 is placed. The casing 14 corresponds to the main body.

Figure 2:
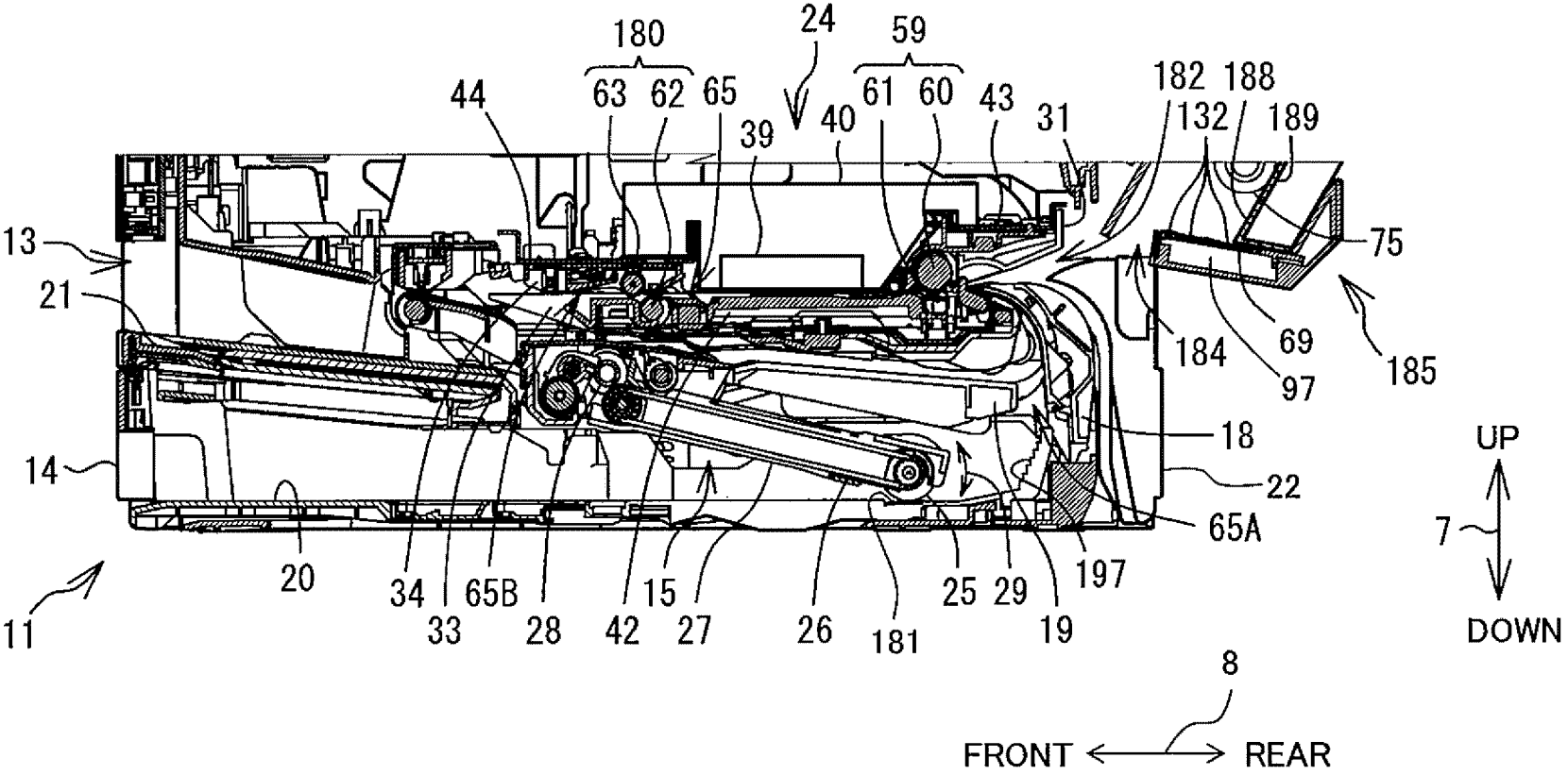
FIG. 2 is a vertical cross-sectional view of an internal structure of a printer portion 11.

As depicted in FIG. 2, the printer portion 11 includes a feed portion 15 which feeds the recording paper from the feed tray 20, a recording portion 24 which records images on the recording paper, a first conveyance roller pair 59, a second conveyance roller pair 180, and the like.

As depicted in FIG. 1, a scanner portion 12 is provided above the printer portion 11. The sizes of a casing or housing body 16 of the scanner portion 12 according to the front-rear direction 8 and the left-right direction 9 are the same as those of the casing 14 of the printer portion 11. Therefore, the casing 14 of the printer portion 11 and the casing 16 of the scanner portion 12 integrally form an outer shape of the multifunction peripheral 10 having the approximately cuboid form. The scanner portion 12 is a flatbed scanner. Further, since the structure of the flatbed scanner is publicly known, any detailed explanation therefor is omitted herein. Further, the scanner portion 12 may be provided with an automatic document feeder (ADF) for separating a plurality of sheets of a manuscript or document one by one and transporting each of the sheets.

<The Printer Portion 11>

The structure of the printer portion 11 will be explained below in detail. The printer portion 11 is one example of the image recording apparatus and, moreover, also includes a conveyance apparatus.

<The Feed Tray 20>

The feed tray 20 depicted in FIGS. 1 and 2 has a box-like shape with an open top. The feed tray 20 is longer in depth (the length according to the front-rear direction 8) and in width (the length according to the left-right direction 9) than in height (the length according to the up-down direction 7). The discharge tray 21 is provided on the upper surface of the feed tray 20 at the front side. The feed tray 20 can accommodate the recording paper by supporting the recording paper with a support surface. For example, the feed tray 20 can support the recording paper in such sizes as from the A4 size to the L size used for photograph recording according to Japanese Industrial Standards. The feed tray 20 is detachably installed in an internal space in communication with the opening 13 of the casing 14. The feed tray 20 is movable back and forth in the front-rear direction 8 with respect to the casing 14 via the opening 13. The casing 14 corresponds to the main body.

<The Feed Portion 15>

As depicted in FIG. 2, the feed portion 15 includes a feed roller 25, a feed arm 26, a drive force transmission mechanism 27, and a separation pad 181. The feed portion 15 is provided above the feed tray 20 and below the recording portion 24. The feed roller 25 is rotatably supported on a shaft by a forward end portion of the feed arm 26. The feed arm 26 swings in the directions indicated by the arrow 29 about a swing shaft 28 provided at its proximal end. By virtue of this, the feed roller 25 can abut against the support surface of the feed tray 20 and the feed roller 25 can be separated therefrom. Therefore, when the feed tray 20 on which the recording paper is stacked is installed in the casing 14, the feed roller 25 can abut against the recording paper on the feed tray 20. Further, the separation pad 181 is provided in an abutment position where the feed roller 25 abuts against the support surface of the feed tray 20. Strictly speaking, the abutment position is where the feed roller 25 abuts against the support surface of the feed tray 20 when the feed tray 20 on which no recording paper is stacked is installed in the casing 14. The separation pad 181 is made of a material having a larger frictional coefficient than the frictional coefficient of the support surface of the feed tray 20, with respect to the recording paper. For example, it is possible to use rubber, cork or the like to make the separation pad 181 but, without being limited to those examples, it is also possible to use other materials.

The drive force of a motor 78 (see FIG. 10) is transmitted to the feed roller 25 via the drive force transmission mechanism 27. The drive force transmission mechanism 27 transmits the rotation transmitted to the swing shaft 28 to the shaft of the feed roller 25 via an endless belt. The feed roller 25 is rotated in such a state that the feed roller 25 is allowed to abut against the uppermost sheet of the recording paper supported by the support surface of the feed tray 20, and thus the recording paper is fed toward a conveyance path 65. When the recording paper is fed toward the conveyance path 65, the forward end of the recording paper abuts against a separation member 197 provided on the back side of the feed tray 20 in the front-rear direction 8. As a result, only the uppermost sheet of the recording paper is separated and then conveyed from the underlaid sheets of the recording paper. On the other hand, the sheets laid under the uppermost sheet of the recording paper are retained in the feed tray 20 as they are without being dragged along by the uppermost sheet of the recording paper.

[The Conveyance Path 65]

As depicted in FIG. 2, the conveyance path 65, which is provided in the internal space of the casing 14, extends while being curved to make a U-turn upward from the back side of the feed tray 20. Further, the conveyance path 65 is bent toward the front side from the back side of the printer portion 11, and then extends substantially straight to the front side of the printer portion 11 to arrive at the discharge tray 21. The conveyance path 65 is roughly classified into a curved passage 65A which makes the U-turn and a straight passage 65B which is straight.

The curved passage 65A is defined by an outer guide member 18, an inner guide member 19, a guide member 31, and the like. The outer guide member 18 and the inner guide member 19, the inner guide member 19 and the guide member 31, and the guide member 31 and the outer guide member 18 are respectively opposed to each other while being separated by a space through which the recording paper can pass. The straight passage 65B is defined by the recording portion 24, a platen 42, a guide member 34, a guide member 33, and the like. The recording portion 24 and the platen 42 are opposed to each other while being separated by a space through which the recording paper can pass, and the guide member 34 and the guide member 33 are opposed to each other while being separated by a space through which the recording paper can pass.

The recording paper, which is fed along the conveyance path 65 by the feed roller 25 of the feed tray 20, is conveyed from the lower side toward the upper side along the curved passage 65A, inverting its conveyance direction. Then, the recording paper is conveyed from the rear side toward the front side along the straight passage 65B without inverting the conveyance direction.

The outer guide member 18 constitutes an outer guide surface of the curved passage 65A when the recording paper is conveyed via the curved passage 65A. The inner guide member 19 constitutes an inner guide surface of the curved passage 65A when the recording paper is conveyed via the curved passage 65A. Further, each of the guide surfaces may be constructed either by a single surface or by forming an envelope surface of the leading ends of a plurality of ribs.

The guide member 31 is arranged above the inner guide member 19 on the immediately upstream side (the back side) of the first conveyance roller pair 59. The outer guide member 18 and the guide member 31 also define a bypass route 182 described later on.

<Back Surface Cover 22>

As depicted in FIG. 2, a back surface cover 22 constitutes a part of the back surface of the casing 14 while supporting the outer guide member 18. The back surface cover 22 is supported swingably on a shaft with respect to the casing 14 on its lower side at both left and right ends. The back surface cover 22 is allowed to swing about the swing shaft provided on its lower side along the left-right direction 9 so that the upper side thereof is inclined backward, and thus a part of the conveyance path 65 and a part of the bypass route 182 described later on are open (exposed) to the outside of the casing 14.

The outer guide member 18 is also supported swingably on a shaft with respect to the casing 14 on its lower side at both left and right ends in the same manner as the back surface cover 22. In such a state that the back surface cover 22 is swung to be inclined backward, the outer guide member 18 is allowed to swing about the swing shaft provided on its lower side along the left-right direction 9 so that the upper side thereof is inclined backward. By allowing the outer guide member 18 to swing to be inclined backward, at least a part of the curved passage 65A is open or exposed. As depicted in FIG. 2, in a case that the back surface cover 22 is closed to come into an upstanding state, the outer guide member 18 is supposed by the back surface cover 22 from the rear side to be maintained in an upstanding state, so that the outer guide member 18 is opposed to the inner guide member 19 to define a part of the curved passage 65A.

<The First Conveyance Roller Pair 59 and Second Conveyance Roller Pair 180>

As depicted in FIG. 2, in the conveyance path 65, the first conveyance roller pair 59 is provided on the upstream side of the recording portion 24 in the conveyance direction of the recording paper. The first conveyance roller pair 59 has a first conveyance roller 60 and a pinch roller 61. Likewise, the second conveyance roller pair 180 is provided on the downstream side of the recording portion 24 in the conveyance direction. The second conveyance roller pair 180 has a second conveyance roller 62 and a spur roller 63. The rotation of the motor 78 (see FIG. 10) is transmitted to the first conveyance roller 60 and the second conveyance roller 62 to rotate the both. The first conveyance roller pair 59 and the second conveyance roller pair 180 transport the recording paper in the conveyance direction along the conveyance path 65 by rotating the first conveyance roller 60 and the second conveyance roller 62 in a state that the recording paper is nipped between the respective rollers constructing the first conveyance roller pair 59 and the second conveyance roller pair 180. The first conveyance roller pair 59 corresponds to the conveyance portion.

<The Recording Portion 24>

As depicted in FIG. 2, the recording portion 24 is provided between the first conveyance roller pair 59 and the second conveyance roller pair 180. The recording portion 24 includes a carriage 40 and a recording head 39. The carriage 40 is supported to be reciprocatingly movable in the left-right direction 9 by guide rails 43 and 44 provided on the back side and the front side of the platen 42. A publicly known belt mechanism is provided for the guide rail 44. The carriage 40 is connected to an endless belt of the belt mechanism. The carriage 40 reciprocates in the left-right direction 9 along the guide rails 43 and 44 in accordance with the rotation of the endless belt. When the carriage 40 and the recording head 39 face the platen 42 with a spacing distance intervening therebetween, the carriage 40, the recording head 39 and the platen 42 define a part of the straight passage 65B.

The recording head 39 is carried on the carriage 40. A plurality of nozzles are formed on the lower surface of the recording head 39. Inks are supplied from ink cartridges (not depicted) to the recording head 39. The recording head 39 selectively discharges the inks as minute ink droplets from the plurality of nozzles. When the carriage 40 is moved in the left-right direction 9, the ink droplets are discharged from the nozzles to the recording paper supported by the platen 42. The discharged ink droplets come to adhere to the recording paper on the platen 42, and thus images are recorded on the recording paper.

<The Bypass Route 182>

As depicted in FIG. 2, an opening 184 is provided above the back surface cover 22 on the back surface of the casing 14. The bypass route 182, which extends from the opening 184 to the first conveyance roller pair 59, is formed in the casing 14. The bypass route 182 extends obliquely downward from the back side to the front side in the casing 14 in the front-rear direction 8. The bypass route 182 is defined by the guide member 31, the outer guide member 18, the back surface cover 22, and the like. The guide member 31 constitutes an upper guide surface when the recording paper is conveyed via the bypass route 182. The outer guide member 18 and the back surface cover 22 constitute a lower guide surface when the recording paper is conveyed via the bypass route 182. Both of the curved passage 65A and the straight passage 65B of the conveyance path 65 are arranged under or below the bypass route 182. Each of the outer guide member 18 and the back surface cover 22 is allowed to swing so that the upper side thereof is inclined backward, and thus a part of the bypass route 182, as well as a part of the conveyance path 65, is open or exposed to the outside of the casing 14.

The recording paper loaded on a bypass tray 71 described later on is guided obliquely downward via the bypass route 182. The recording paper is guided via the straight passage 65B of the conveyance path 65, and conveyed by the first conveyance roller pair 59. Then, image recording is carried out on the recording paper by the recording portion 24, and then the recording paper is discharged to the discharge tray 21. In this way, the recording paper loaded on the bypass tray 71 is conveyed via the route having a substantially straight shape (the route in which the front surface and the back surface of the recording paper are not turned over in the up-down direction 7).

<Feed Apparatus 70>

Figure 6:
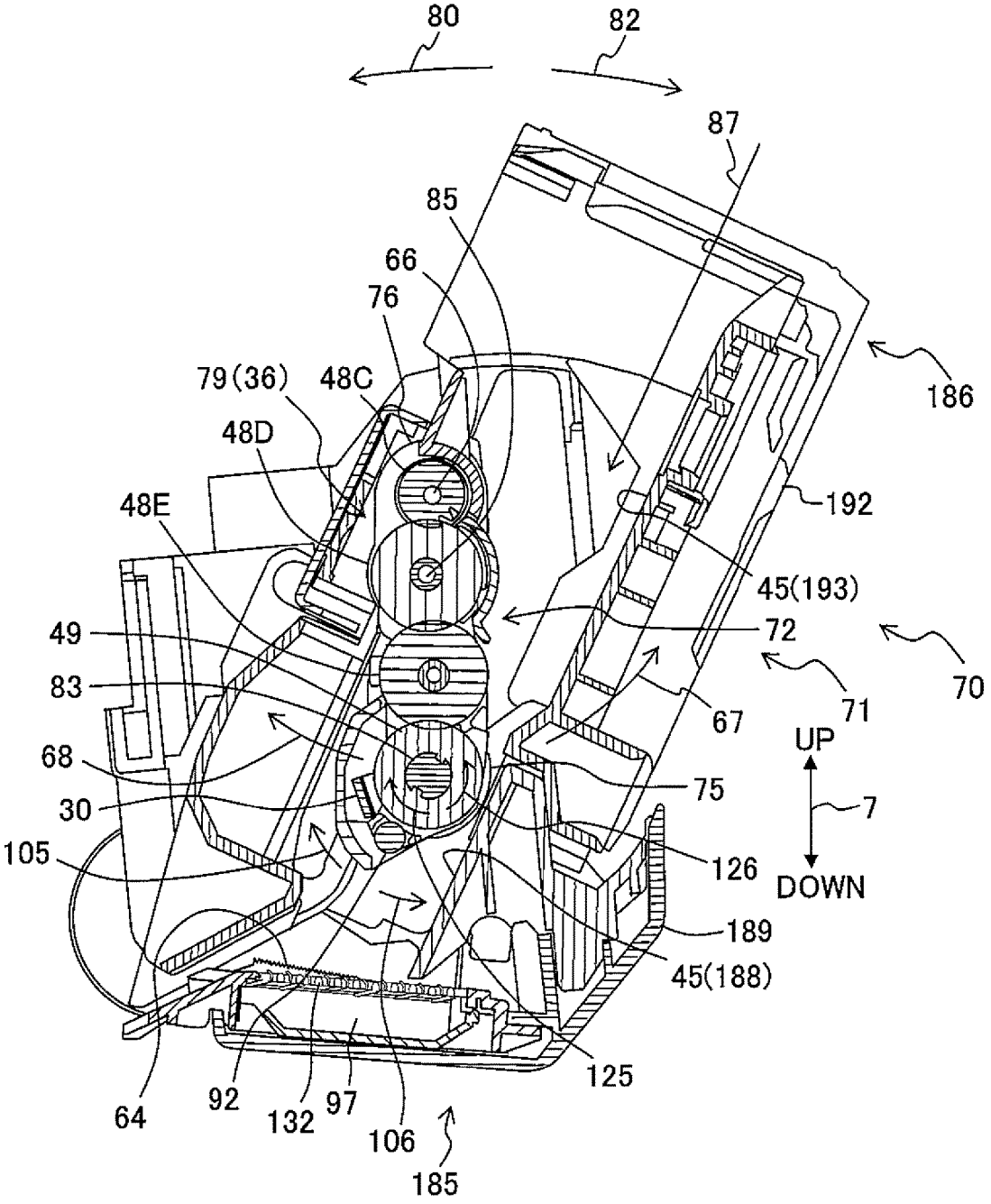
FIG. 6 is a cross-sectional view along the line VI-VI of FIG. 5.

The printer portion 11 includes a feed apparatus 70 (see FIG. 6). The feed apparatus 70 includes the bypass tray 71 and a feed portion 72. As depicted in FIG. 6, the feed portion 72 includes a feed roller 75, a feed arm 76, a drive force transmission mechanism 79, and a swing member 30. The feed apparatus 70 corresponds to the equipped unit. The feed roller 75 corresponds to the drive portion.

<The Bypass Tray 71>

Figure 4:
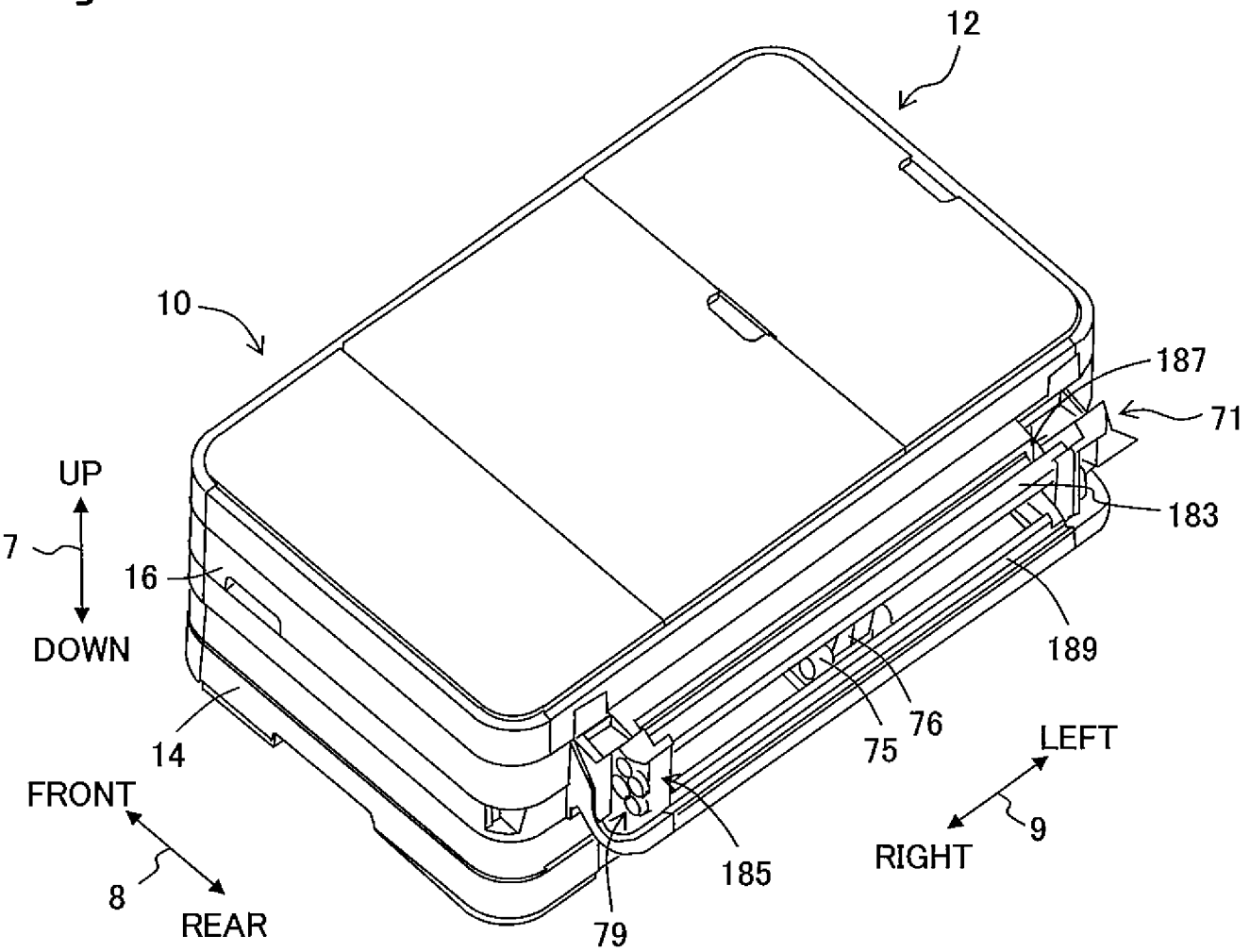
FIG. 4 is a perspective external view of the multifunction peripheral 10 on a back surface side in which the movable portion 186 is removed.

As depicted in FIGS. 1 and 4, the bypass tray 71 is provided on the back wall of the casing 16 of the scanner portion 12. The bypass tray 71 is adapted to load the recording paper independently from the feed tray 20.

Figure 3:
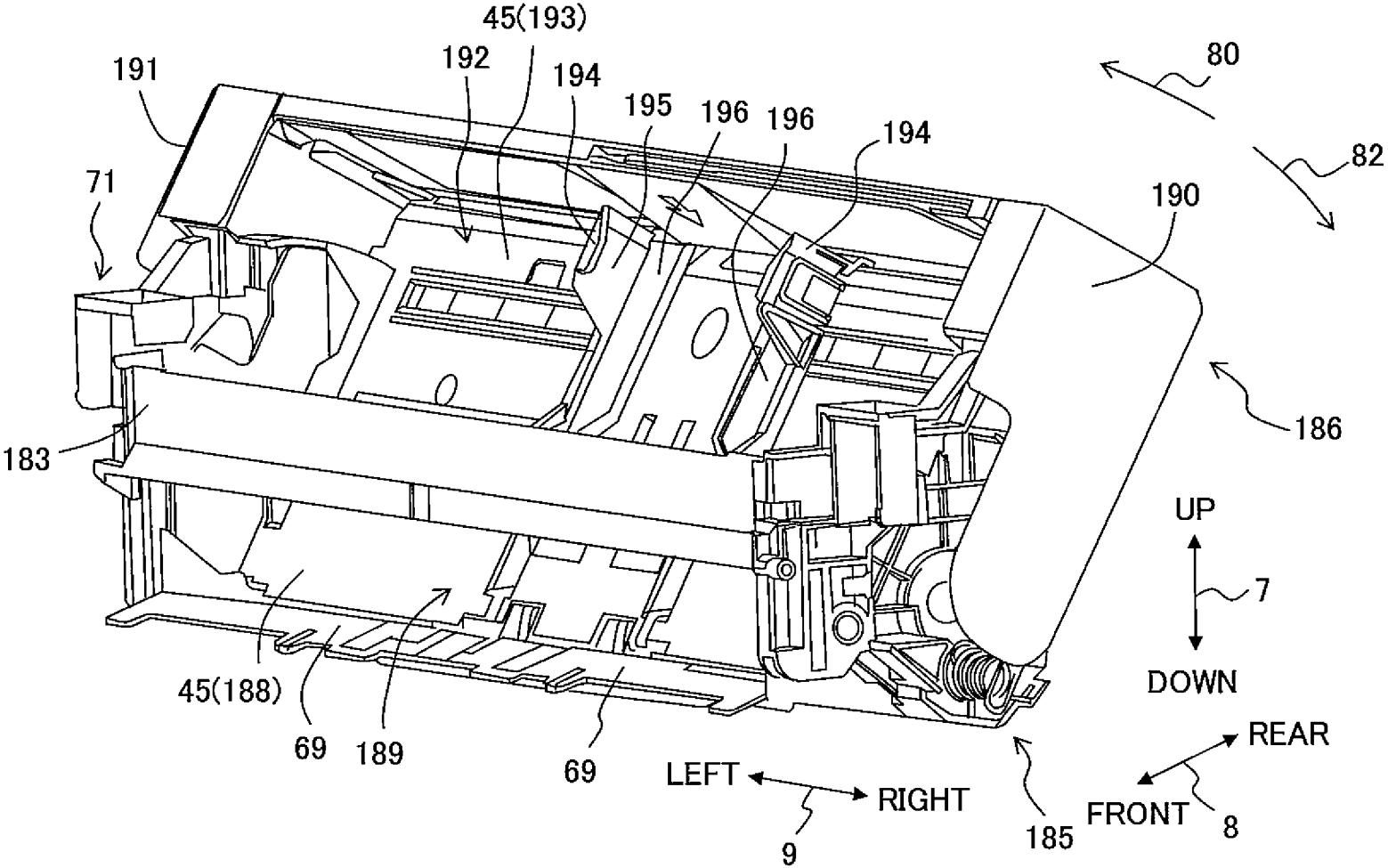
FIG. 3 is a perspective view of a bypass tray 71 in which the movable portion 186 is in an inclined or laid-down state.

As depicted in FIGS. 1 and 3, a fixed portion 185, which extends downward to cover the opening 184 (see FIG. 2) therewith, is formed on the back wall of the casing 16 of the scanner portion 12. The fixed portion 185 constitutes a part of the bypass tray 71 on the downstream side according to a feed direction 87. As depicted in FIG. 3, a movable portion 186 is provided on the upper side of the fixed portion 185 so as to be swingable in the directions indicated by the arrows 80 and 82 with respect to the fixed portion 185. The bypass tray 71 is constructed by the fixed portion 185 and the movable portion 186.

As depicted in FIG. 4, a slit-shaped opening 187, which extends in the left-right direction 9, is formed in the upper surface of the fixed portion 185. In the bypass tray 71, a passage is formed from the opening 187 to arrive at the bypass route 182 (see FIG. 2). As depicted in FIG. 3, the fixed portion 185 is provided with a support member 189 including a support surface 188. The support surface 188 extends obliquely downward to the bypass route 182 (see FIG. 2). The lower end of the support member 189 forms a part of the guide surface which guides the recording paper conveyed via the bypass route 182.

As depicted in FIG. 3, a reinforcing member 183, which rotatably supports a swing shaft 66 (see FIG. 7) of the feed arm 76, is provided above the support surface 188 on the upper end side of the support member 189. The swing shaft 66 constitutes a part of the drive force transmission mechanism 79 (see FIG. 6), and is rotated by the rotational drive force transmitted from the motor 78. The drive force transmission mechanism 79 will be explained in detail later on.

As depicted in FIG. 6, the feed arm 76 is swingably supported by the swing shaft 66. That is, the feed arm 76 is swingable about the swing shaft 66. The feed roller 75 is rotatably supported by the feed arm 76 on the side of a swing forward end. The feed arm 76 extends downward from the swing shaft 66 toward the support surface 188 of the support member 189. The feed arm 76 is arranged at the center of the fixed portion 185 according to the left-right direction 9.

As depicted in FIG. 6, the feed roller 75 is connected with the swing shaft 66 via a plurality of gears 48C, 48D, 48E, and 49. The rotation of the swing shaft 66 is transmitted to the feed roller 75 via the plurality of gears 48C, 48D, 48E, and 49 to rotate the feed roller 75. By the rotation of the feed roller 75 in contact with the uppermost sheet of the recording paper supported by the support surface 188 of the bypass tray 71, the uppermost sheet of the recording paper is fed in the feed direction 87 (see FIG. 6) via the bypass route 182 (see FIG. 2). The sheets under the uppermost sheet of the recording paper are separated by a separation member 132 provided on a lower guide member 97, and thus retained in the bypass tray 71 without being dragged along by the uppermost sheet of the recording paper.

As depicted in FIG. 3, the movable portion 186 is provided on the upper side of the fixed portion 185 to be swingable with respect to the fixed portion 185. The movable portion 186 is swingable between the upstanding state in which the movable portion 186 upstands in the up-down direction 7 as depicted in FIG. 1 and the inclined or laid-down state in which the movable portion 186 is inclined with respect to the up-down direction 7 as depicted in FIG. 3. The position of the movable portion 186 in the upstanding state corresponds to the first swinging position. The position of the movable portion 186 in the inclined state corresponds to the second swinging position.

The upstanding state is a state for reducing the space for the movable portion 186 on the back surface side of the casing 14. The bypass tray 71 is not used when the movable portion 186 is in the upstanding state. The back surface of the movable portion 186 in the upstanding state is substantially parallel to the back surface of the casing 14. When the movable portion 186 is in the upstanding state, the swing forward end of the movable portion 186 is positioned above the swing proximal end of the movable portion 186. The inclined state is the state in which the movable portion 186 is inclined obliquely upwardly toward the outside of the casing 14, and thus the inclined support surfaces 188 and 198 are substantially provided as one flat surface, and the inclined state is the state in which the bypass tray 71 can be used. With the movable portion 186 in the inclined state, the swing forward end separates from the back surface of the casing 14 more than the swing proximal end. Whether the movable portion 186 is allowed to be in the upstanding state or in the inclined state can be arbitrarily selected in accordance with the operation of a user.

As depicted in FIG. 3, side walls 190 and 191 are provided on both sides of the movable portion 186 in the left-right direction 9. The side walls 190 and 191 cover parts of the both sides of the fixed portion 185 according to the left-right direction 9. The drive force transmission mechanism 79, which is provided on the right side of the fixed portion 185 according to the left-right direction 9, is covered by the side wall 190 of the movable portion 186.

As depicted in FIG. 3, a support member 192 is provided to span the side walls 190 and 191 of the movable portion 186. In the inclined state of the movable portion 186, the support surface 193 provided on the upper surface of the support member 192 and the support surface 188 form substantially the same flat surface. That is, a flat surface 45, which is formed by the support surface 188 of the support member 189 and the support surface 193 of the support member 192, supports the recording paper in the bypass tray 71 with the movable portion 186 in the inclined state. In the upstanding state of the movable portion 186, the support surface 193 is perpendicular to the placement surface for the multifunction peripheral 10. In other words, with the movable portion 186 in the upstanding state, the support surface 193 is in parallel to the up-down direction 7 and the left-right direction 9.

As depicted in FIG. 3, the support member 192 is provided with a pair of side guides 194. The pair of side guides 194 are provided to separate from each other in the left-right direction 9, and to protrude upward from the support surface 193. The side guides 194 each include a guide surface 195 which extends in the feed direction 87 of the recording paper in the bypass tray 71. When the recording paper on the support surface 193 is conveyed, the side edge of the recording paper according to the feed direction 87 (see FIG. 6) is guided by the guide surface 195.

The side guides 194 each have a support surface 196 along the support surface 193 of the support member 192. That is, each of the side guides 194 is approximately L-shaped in which the guide surface 195 is orthogonal to the support surface 196. Although there is a small difference in height between the support surfaces 193 and 196, the support surfaces 196 are substantially flush with the support surface 193. The support surfaces 196 support the recording paper together with the support surfaces 188 and 193. The distance, by which the pair of side guides 194 are separated from each other in the left-right direction 9, is variable. By virtue of this, the side edges of the recording paper in various sizes supported by the support surfaces 193 and 196 can be guided by the guide surfaces 195 of the side guides 194.

<The Feed Roller 75 and the Feed Arm 76>

As depicted in FIG. 6, the feed roller 75 is arranged to face the support surface 188 of the fixed portion 185. The feed roller is provided in the form of two feed rollers 75 at an interval in the left-right direction 9 to interpose the feed arm 76 therebetween. The two feed rollers 75 are arranged at an interval to be spaced from each other in the left-right direction 9, that is, in an axial direction of a rotational shaft 83 which is a common rotational shaft.

The feed arm 76 is connected with the swing shaft 66 by a torsion spring (not depicted). By virtue of this, the feed arm 76 is biased by the torsion spring in the direction indicated by the arrow 67, that is, toward the flat surface 45 of the bypass tray 71. Further, the structure for basing the feed arm 76 in the direction of the arrow 67 is not limited to a structure using the torsion spring. For example, a coil spring may be arranged on the frontward side of the feed arm 76 such that one end of the coil spring is connected to the feed arm 76 and the other end of the coil spring is connected to a frame of the printer portion 11. In this structure, the feed arm 76 is still biased by the coil spring in the direction of the arrow 67.

<The Swing Member 30>

As depicted in FIG. 6, the swing member 30 is provided for swinging in the directions indicated by arrows 105 and 106 to swing the feed arm 76 in directions indicated by arrows 67 and 68 and, as a result, to cause the feed roller 75 to contact with and separate from the flat surface 45 of the bypass tray 71 or the recording paper supported on the flat surface 45. A roller 92 is provided at the swing forward end of the swing member 30. The roller 92 is rotatably supported on the swing member 30.

The swing member 30 is connected with the gear 49 via an unillustrated torque limiter. By imparting the rotational drive force of the motor 78 to the swing member 30 from the gear 49 via the torque limiter, the swing member 30 swings in the directions indicated by the arrows 105 and 106.

The feed arm 76 is biased by the torsion spring (not depicted) toward the flat surface 45 of the bypass tray 71. When the swing member 30 swings in the direction of the arrow 106 from the position depicted in FIG. 6, then the roller 92 comes to contact with the flat surface 45 of the bypass tray 71 or the recording paper supported on the flat surface 45. On the other hand, raised by the swing member 30, the feed roller 75 is separated from the flat surface 45 of the bypass tray 71 or the recording paper supported on the flat surface 45. When the roller 92 is located in the position depicted in FIG. 6, the roller 92 is separated from the flat surface 45 of the bypass tray 71. On the other hand, because the feed roller 75 is biased by the torsion spring toward the flat surface 45 of the bypass tray 71, it is in contact with the flat surface 45 of the bypass tray 71 or the recording paper supported on the flat surface 45.

<The Moving Member 64>

Figure 7:
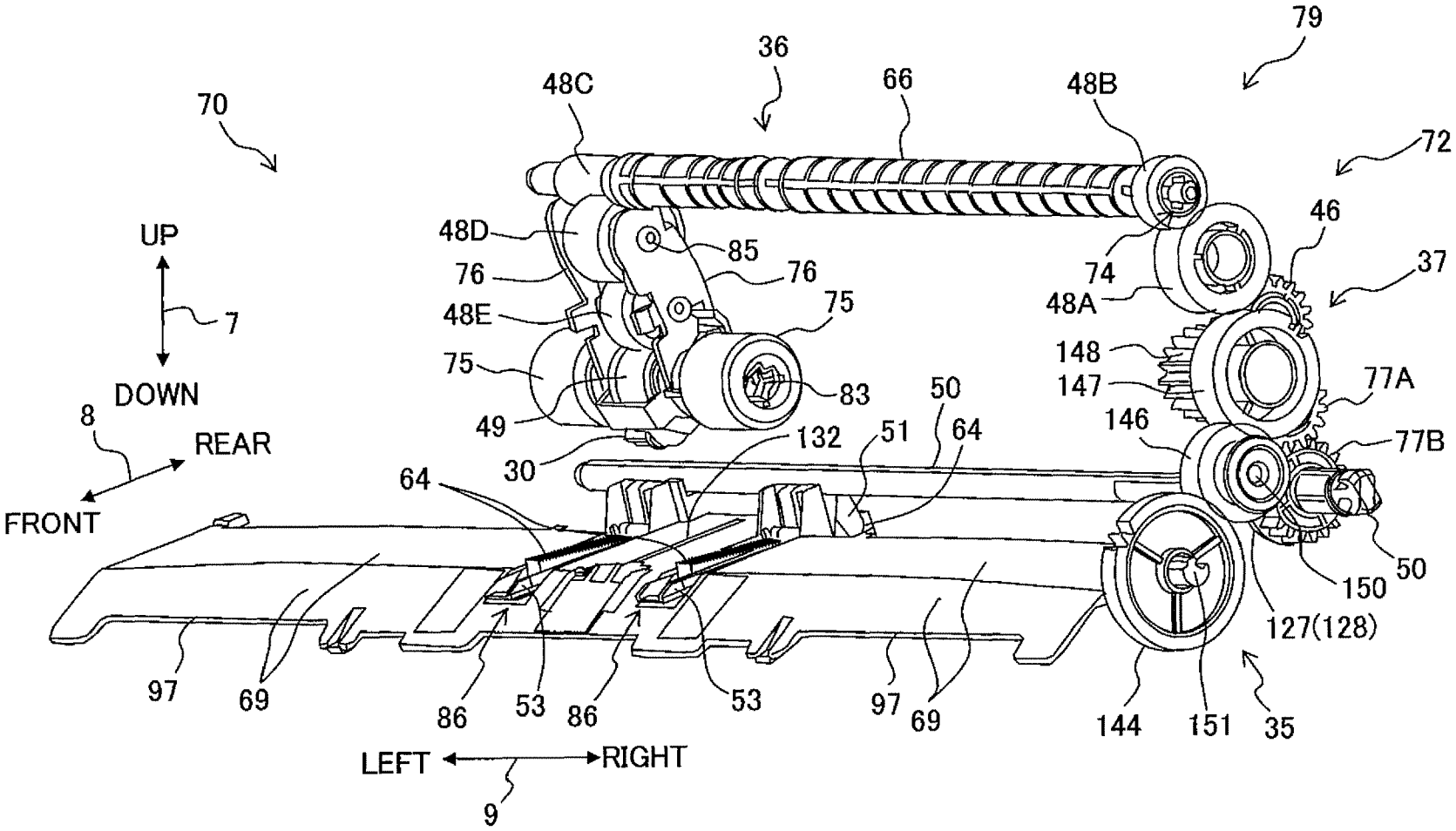
FIG. 7 is a perspective view of an internal structure of the feed apparatus 70.

As depicted in FIG. 7, the moving member 64 is arranged in a recess 86 provided in an upper surface 69 of the lower guide member 97. The moving member 64 is movable into and from the recess 86 and, with a part thereof projecting from the recess 86, is contactable with the forward end of the recording paper supported by the bypass tray 71.

A drive force is transmitted to the moving member 64 from a gear 77B of the third drive force transmission portion 37 via a swing shaft 50 and a slide cam 53. That is, the slide cam 53 transmits the rotation of the gear 77B as linear drive for the moving member 64 to move into and from the recess 86.

A torque limiter 127 (see FIGS. 5 and 7) is provided between the swing shaft 50 and the gear 77B of the third drive force transmission portion 37. The torque limiter 127 is adapted to switch between the transmission and no transmission of the rotational drive force by the third drive force transmission portion 37.

Figure 5:
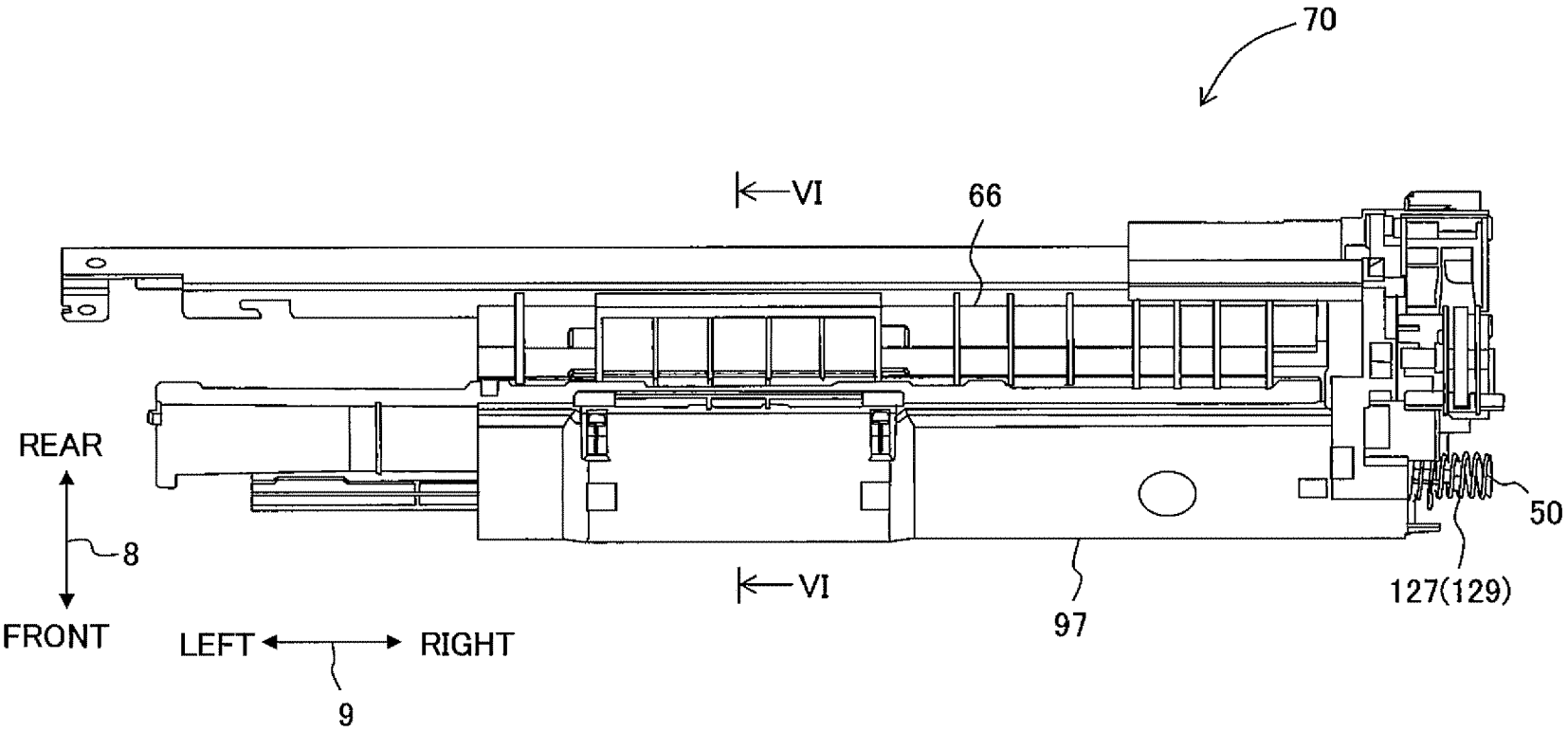
FIG. 5 is a front view of a feed apparatus 70.

The torque limiter 127 includes a flange portion 128 (see FIG. 7), a friction member (not depicted), and a compression coil spring 129 (see FIG. 5). The flange portion 128 projects from the periphery of the swing shaft 50. The friction member (not depicted) is arranged between the flange portion 128 and the gear 77B. The compression coil spring 129 is arranged on the farther side of the gear 77B from the friction member to bias the gear 77B toward the friction member. Being biased by the compression coil spring 129, the gear 77B is pressed against the flange portion 128 via the friction member. Further, the torque limiter 127 is not limited to the above structure, but can adopt any possible structure for a torque limiter.

When the moving member 64 is in operation, when the moving member 64 is movable, then the torque limiter 127 transmits the rotational drive force from the gear 77B to the flange portion 128 via the friction member. That is, the gear 77B and the swing shaft 50 provided with the flange portion 128 rotate integrally via the torque limiter 127.

On the other hand, when the moving member 64 is in operation, when the moving member 64 has already moved to a movement end, that is, to the projecting limit or withdrawing limit, then the torque limiter 127 cuts off the transmission of the rotational drive force from the gear 77B to the swing shaft 50. That is, the rotation of the swing shaft 50 stops, and the gear 77B runs idle about the swing shaft 50.

<The Drive Force Transmission Mechanism 79>

Figure 9:
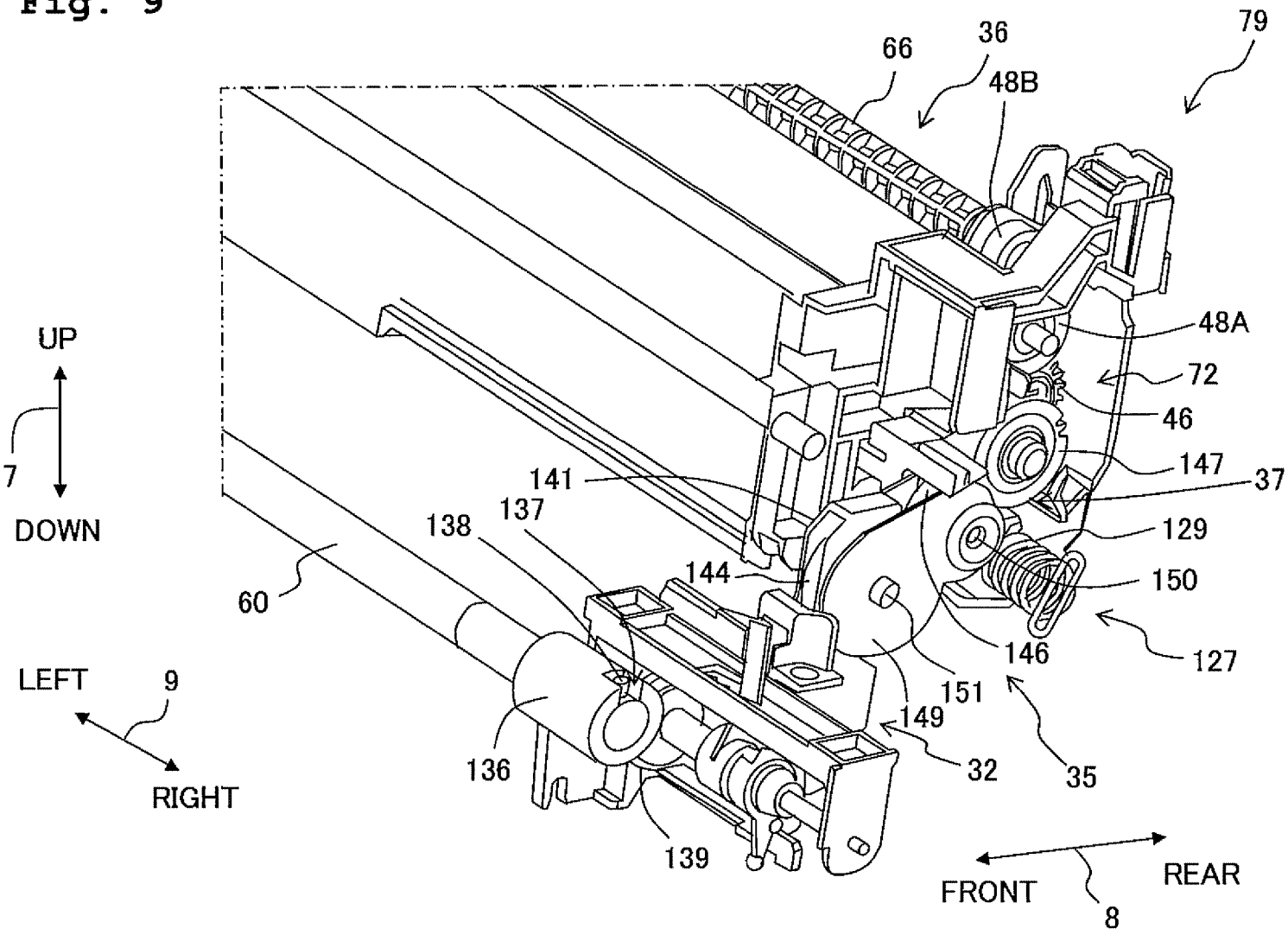
FIG. 9 is an enlarged perspective view of the mechanism of transmitting the drive force from the motor 78.
Figure 10:
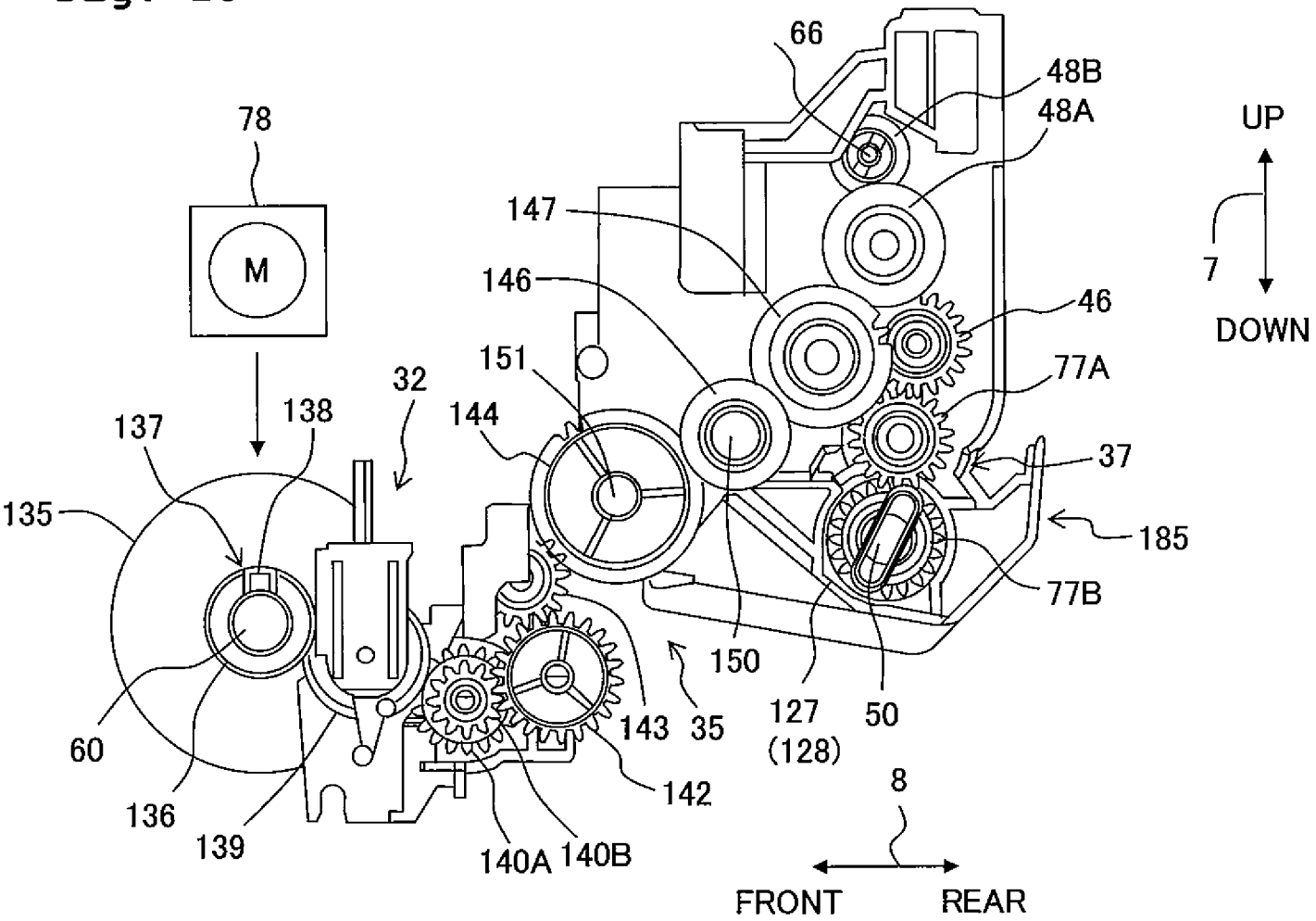
FIG. 10 is a lateral view of the mechanism of transmitting the drive force from the motor 78.

As depicted in FIG. 10, the printer portion 11 is provided with a motor 78 adapted to rotate positively or negatively. Further, as depicted in FIGS. 7 to 10, the printer portion 11 is provided with the drive force transmission mechanism 79 formed from a plurality of gears engaged with each other. The rotational drive force generated by the positive or negative rotation of the motor 78 is transmitted to the first conveyance roller 60 and, furthermore, transmitted to the feed roller 75 and the moving member 64 via the drive force transmission mechanism 79.

Figure 8:
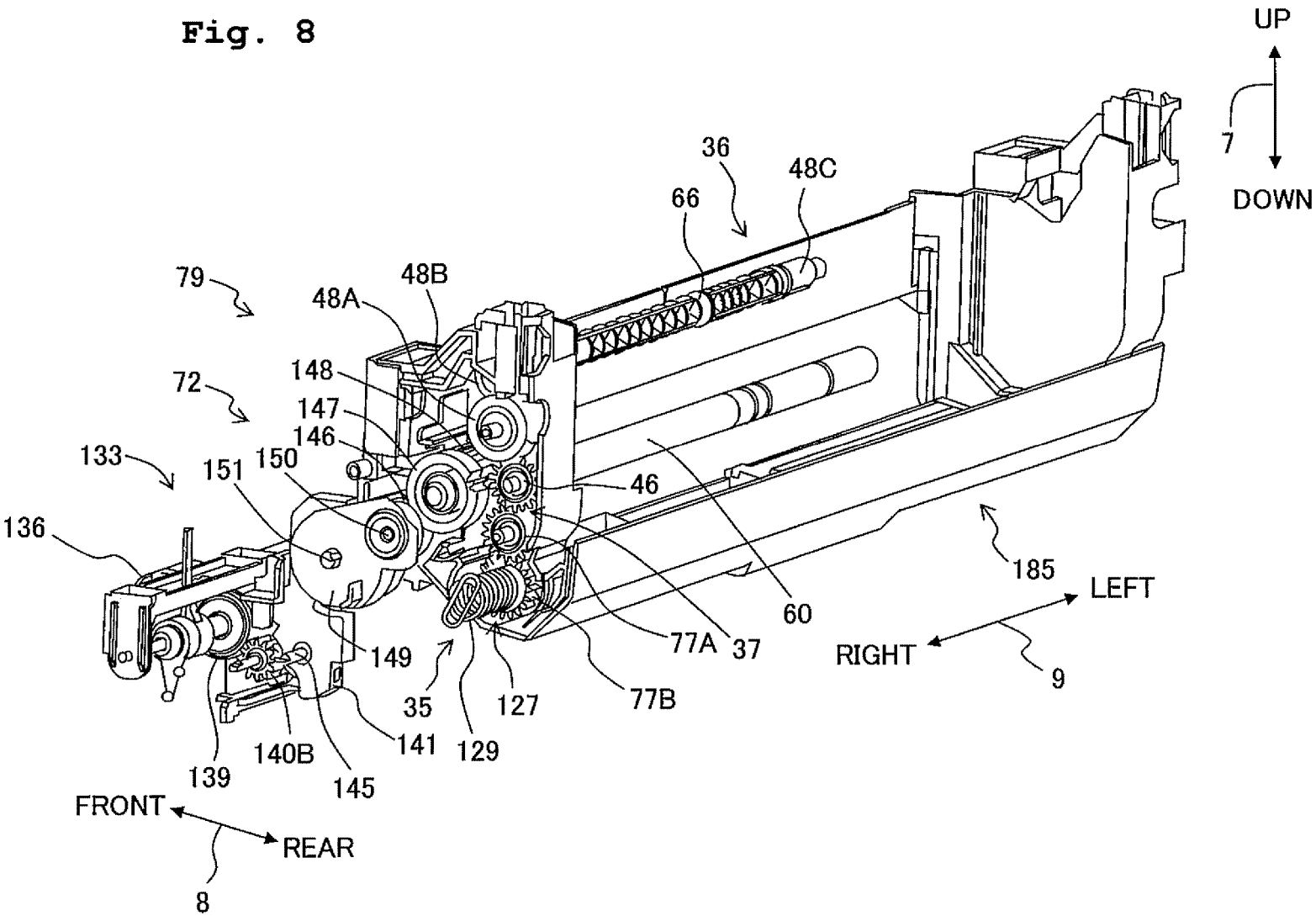
FIG. 8 is a perspective view of a mechanism of transmitting a drive force from a motor 78.

As depicted in FIGS. 8 to 10, the drive force transmission mechanism 79 includes a drive force transmission portion 32 on the main body side, a first drive force transmission portion 35, a second drive force transmission portion 36, a third drive force transmission portion 37, and an intermediate gear 46. The drive force transmission portion 32 on the main body side is provided inside the casing 14. The first drive force transmission portion 35, the second drive force transmission portion 36, the third drive force transmission portion 37, and the intermediate gear 46 are provided in the fixed portion 185 of the feed apparatus 70.

The motor 78, the first conveyance roller 60, and the drive force transmission portion 32 on the main body side are provided inside the casing 14 (not depicted in FIGS. 8 to 10). Although not depicted in each of the figures, a gear is provided on the rotational shaft of the motor 78, and that gear is engaged with a gear 135 provided at the left end side of the first conveyance roller 60. The rotational drive force of the motor 78 is transmitted to the gear 135 to rotate the first conveyance roller 60. Further, although not depicted in each of the figures, the drive force of the motor 78 is transmitted to the second conveyance roller 62 via the gear 135.

As depicted in FIG. 9, a gear 136 is provided on the right end side of the first conveyance roller 60. A key groove 137 is formed in the gear 136. The key groove 137 engages a key 138 projecting from the first conveyance roller 60 in a radial direction. The key groove 137 has a backlash for the key 138. That is, according to a circumferential direction (rotational direction) of the first conveyance roller 60, the key groove 137 is wider than key 138. The backlash of the key groove 137 for the key 138 is set to such a size that the rotation of the gear 136 is not transmitted to the first conveyance roller 60 when the gear 136 is rotated along with the swinging of the bypass tray 71 with respect to the casing 14 of the printer portion 11 together with the casing 16 of the scanner portion 12. The gear 136 corresponds to the fourth gear.

As depicted in FIGS. 8 to 10, the gear 136 is connected to an idle gear 140A via a switch gear 139. The idle gear 140A is provided with a reduction gear 140B to rotate coaxially. The reduction gear 140B engages with a gear 142 positioned below among three gears 142, 143 and 144 supported by a first gear holder 141. A gear train is formed from the gear 136, switch gear 139, idle gear 140A, reduction gear 140B and gears 142, 143 and 144 which engage with each other. The first gear holder 141 is rotatably supported by a support shaft 145. The gears 142 and 143 are rotatably sandwiched between a pair of flat plates and supported by the first gear holder 141. Further, although not depicted in each of the figures, the support shaft 145 is supported by a frame and the like inside the casing 14.

The first gear holder 141 extends upward and rearward from the support shaft 145 to support the gear 142 supported by the support shaft 145, the gear 143 engaging with the gear 142, and the gear 144 engaging with the gear 143. The three gears 142, 143 and 144 supported by the first gear holder 141 swing integrally with the swinging of the first gear holder 141. The gear 143 corresponds to the first gear, while the gear 144 corresponds to the third gear. With the gear train structured in this manner, the drive force transmission portion 32 on the main body side transmits, to the gear 144, the rotational drive force transmitted from the motor 78 via the first conveyance roller 60.

The first drive force transmission portion 35 is arranged on the right side of the bypass tray 71 and the lower guide member 97 according to the left-right direction 9. The first drive force transmission portion 35 includes four gears 144, 146, 147 and 148. The three gears 144, 146 and 147 of the four gears form a row of gears engaging with each other. Further, the gear 144 is a common gear between the drive force transmission portion 32 on the main body side and the first drive force transmission portion 35. The gear 146 corresponds to the second gear.

The gears 144 and 146 are supported by a second gear holder 149. The second gear holder 149 is rotatably supported by a support shaft 150. The gears 144 and 146 are sandwiched between a pair of flat plates and rotatably supported by the second gear holder 149. The support shaft 150 is supported by the fixed portion 185 of the bypass tray 71. The second gear holder 149 extends downward and frontward from the support shaft 150. The support shaft 150 is also the support shaft for the gear 146. Further, the second gear holder 149 is omitted in FIG. 7.

A connecting shaft 151 connects the swing forward end of the first gear holder 141 and the swing forward end of the second gear holder 149. The connecting shaft 151 is rotatable with respect to the first gear holder 141 and the second gear holder 149. Therefore, the first gear holder 141 and the second gear holder 149 are swingable while being connected by the connecting shaft 151 without changing the distance from the support shafts 145 and 150. The gear 144 is supported by the connecting shaft 151 so as to be supported by both the first gear holder 141 and the second gear holder 149. Therefore, regardless of the swinging positions of the first gear holder 141 and the second gear holder 149, the pitches of the gears 142, 143 and 144 and the pitch of the gears 144 and 146 are kept constant respectively.

The gears 147 and 148 are arranged to align in a thrust direction and to rotate integrally about the same rotational shaft. The gear 147 engages with the gear 146. The gear 148 engages with the intermediate gear 46. With the gear train structured in this manner, the first drive force transmission portion 35 transmits, to the intermediate gear 46, the rotational drive force transmitted from the motor 78 via the gear 144.

As depicted in FIG. 7, the second drive force transmission portion 36 includes five gears 48A to 48E, a gear 49, and a swing shaft 66. The gears 48A and 48B engage with each other. The swing shaft 66 is provided to extend along the left-right direction 9 from the right side of the bypass tray 71 and the lower guide member 97 up to almost the central portion of the bypass tray 71 and the lower guide member 97 according to the left-right direction 9. The gear 48A engages with the intermediate gear 46. The gear 48B is connected with a right end portion of the swing shaft 66 to rotate integrally with the swing shaft 66.

The gears 48C to 48E form a row of gears engaging with each other. The gear 48C arranged at one end of the gear train is fitted on a left end portion of the swing shaft 66 to rotate integrally with the swing shaft 66. The gear 48E arranged at the other end of the gear train engages with the gear 49. The gears 48D and 48E are supported rotatably by the feed arm 76. That is, the second drive force transmission portion 36 includes the row of gears being supported by the feed arm 76 and engaging with each other. The gear 49 is fitted on the rotational shaft 83 of the feed rollers 75 between the pair of feed rollers 75, and is rotatable integrally with the rotational shaft 83 about the rotational shaft 83.

With the gear train structured in this manner, the second drive force transmission portion 36 transmits the rotational drive force from the intermediate gear 46 to the feed rollers 75. The feed rollers 75, to which the positively rotational drive force is transmitted from the motor 78 via the second drive force transmission portion 36, rotate to feed the recording paper supported by the flat surface 45 of the bypass tray 71 in the feed direction 87.

As depicted in FIG. 7, the third drive force transmission portion 37 includes two gears 77A and 77B, a protrusion 51, and a swing shaft 50 for the protrusion 51. The swing shaft 50 is provided to extend in the left-right direction 9 from the right side of the bypass tray 71 and the lower guide member 97 up to almost the central portion of the bypass tray 71 and the lower guide member 97 according to the left-right direction 9.

The gears 77A and 77B form a row of gears engaging with each other. The gear 77A arranged at one end of the gear train engages with the intermediate gear 46. The gear 77B arranged at the other end of the gear train is connected to a right end portion of the swing shaft 50 via the torque limiter 127. By virtue of this, the gear 77B is rotatable integrally with the swing shaft 50 and rotatable independently from the swing shaft 50. The protrusion 51 protrudes toward the moving member 64. A slide cam 53 pressed against the protrusion 51 moves the moving member 64 in a direction of coming into or out of the recess 86. With the gear train and the like structured in this manner, the third drive force transmission portion 37 transmits the rotational drive force from the intermediate gear 46 to the moving member 64.

Further, it is needless to say that the number of gears of the drive force transmission mechanism 79 is not limited to that indicated in this embodiment. Further, at least a part of the drive force transmission mechanism 79 may be constructed of other members than gears. For example, it may be configured to fasten an endless belt on and around the two shafts to transmit the rotation of one shaft to the other shaft.

For example, when the drive force is transmitted from the motor 78 to the feed apparatus 70 via the drive force transmission portion 32 on the main body side, first drive force transmission portion 35, second drive force transmission portion 36 and third drive force transmission portion 37, it is necessary to transmit a sufficient rotary torque to the second drive force transmission portion 36 for the load on a torque limiter provided for swinging the swing member 30. Further, it is necessary to transmit a sufficient rotary torque to the third drive force transmission portion 37 for the load on the torque limiter 127. Further, regardless of the feed roller 75 being rotated in the feed direction 87, when a sheet supported by the bypass tray 71 is not fed due to friction and the like between the sheets of the recording paper, then the feed arm 76 swings toward the sheets to make the feed roller 75 come into a stronger contact with the sheet and, as a result, it is necessary to transmit a larger rotary torque to the feed roller 75.

As described earlier, because a large rotary torque is transmitted to the feed apparatus 70, a load is produced where the feed apparatus 70 is assembled with the casings 14 and 16, and thus the positional relation between the casings 14 and 16 and the feed apparatus 70 may vary to the extent of the looseness and the like in the assembly. With this variation, even when one or both of the first gear holder 141 and the second gear holder 149 has or have swung, the pitches of the gears 142, 143 and 144 and the pitch of the gears 144 and 146 are still kept constant respectively.

Likewise, even when each multifunction peripheral 10 varies in the swinging positions of the first gear holder 141 and the second gear holder 149 due to the variation in the looseness and the like in assembling the feed apparatus 70 with the casings 14 and 16, the pitches of the gears 142, 143 and 144 and the pitch of the gears 144 and 146 are still kept constant respectively.

Figure 11:
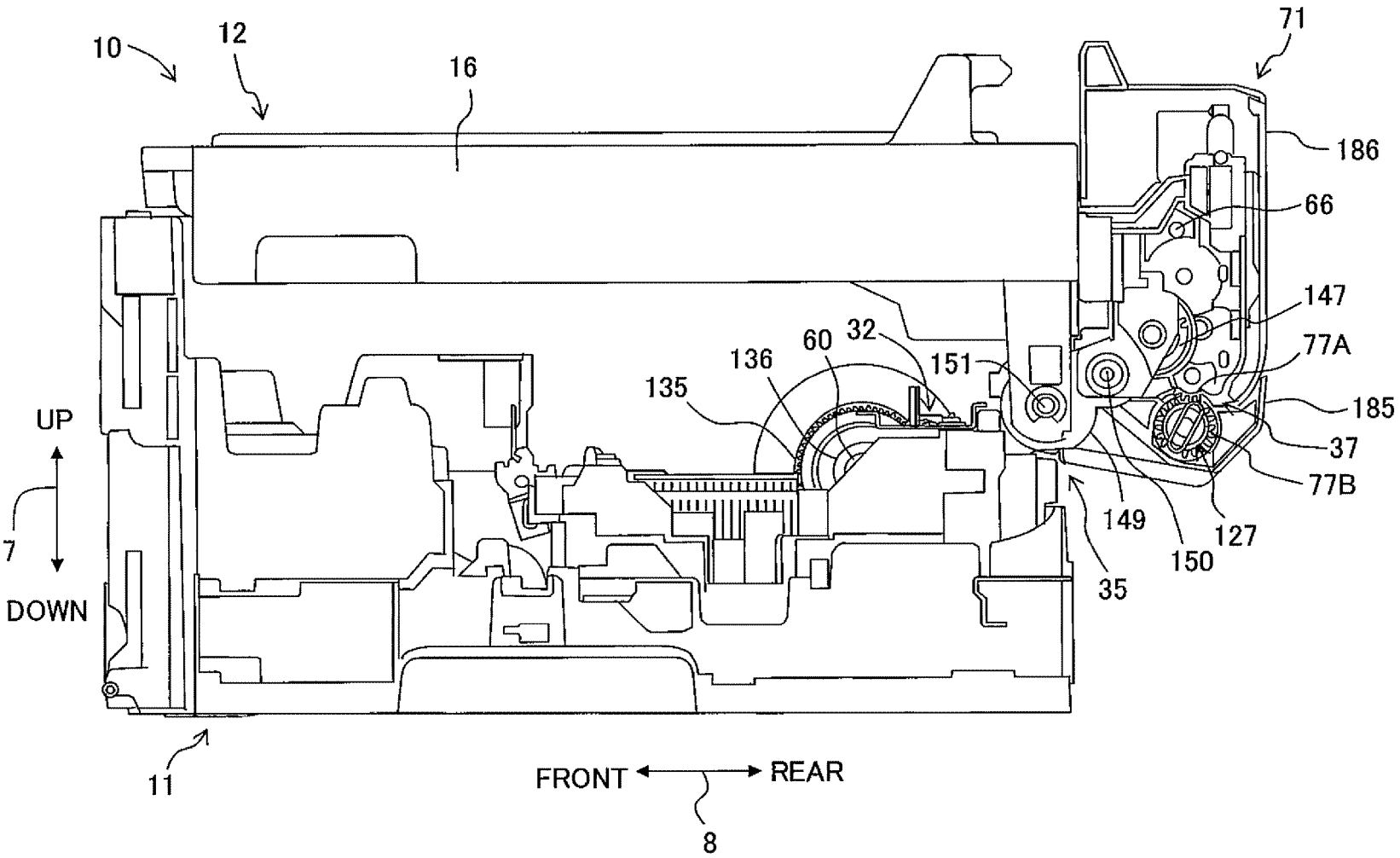
FIG. 11 is a lateral view of a casing 16 being superimposed by a casing 14.

Further, when the multifunction peripheral 10 is in a state of using the print function and the scanner function, as depicted in FIG. 11, the casing 16 of the scanner portion 12 is superimposed right above and upon the casing 14 of the printer portion 11 (the first swinging position).

Figure 12:
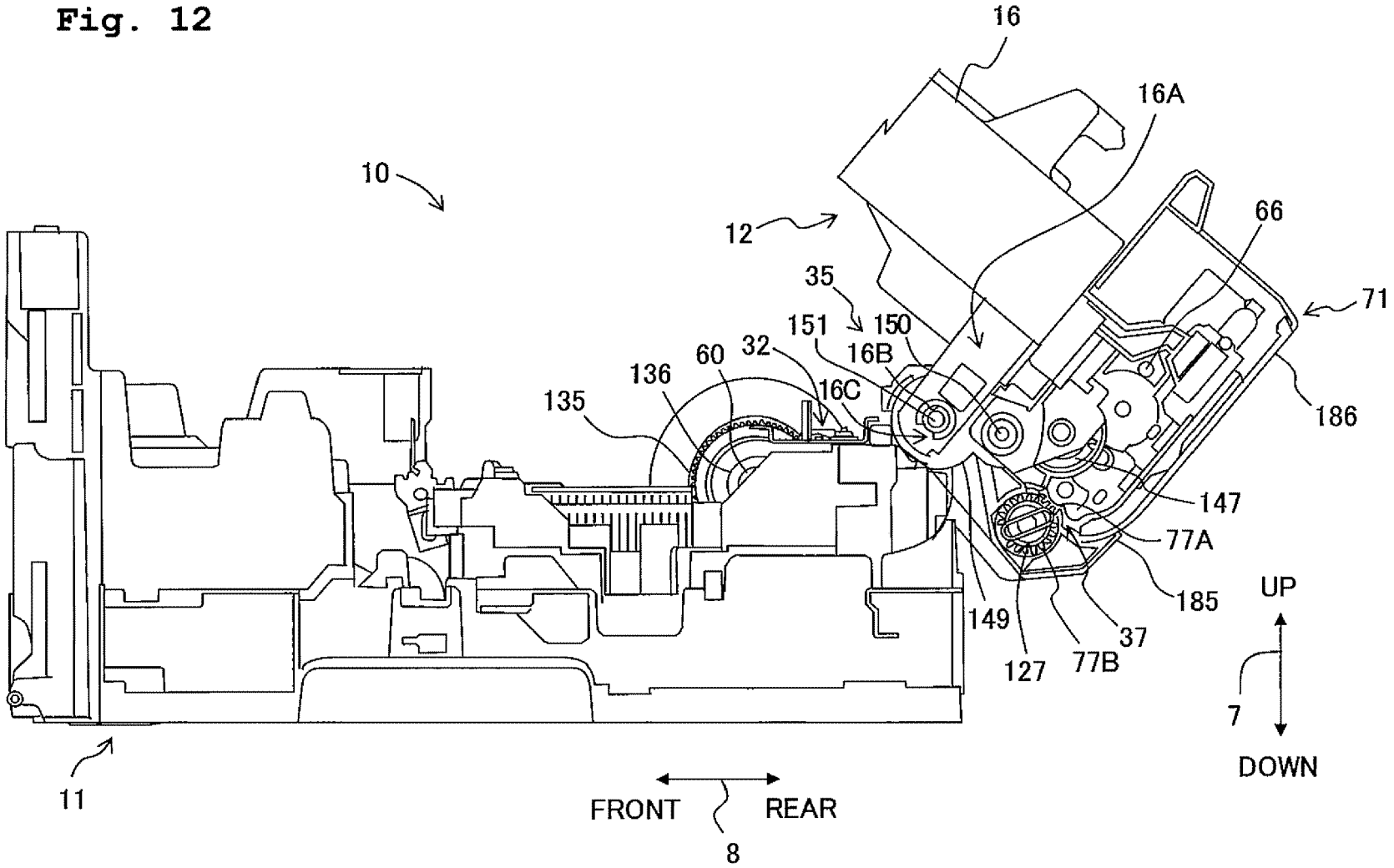
FIG. 12 is a lateral view of the casing 16 being swung as upturned from the casing 14.

For example, for the purposes of releasing a paper jam in the printer portion 11, carrying out an internal maintenance, etc., as depicted in FIG. 12, the casing 16 of the scanner portion 12 is swung to turn upward from the casing 14 of the printer portion 11 (the second swinging position). By swinging the casing 16 to turn upward from the casing 14, a space is formed for the user to access the inside of the upper part of the printer portion 11. Further, for the convenience of explanation, illustration is omitted in FIGS. 11 and 12 for the casing 14, side walls 190 and 191 of the bypass tray 71, and the like.

Figure 13:
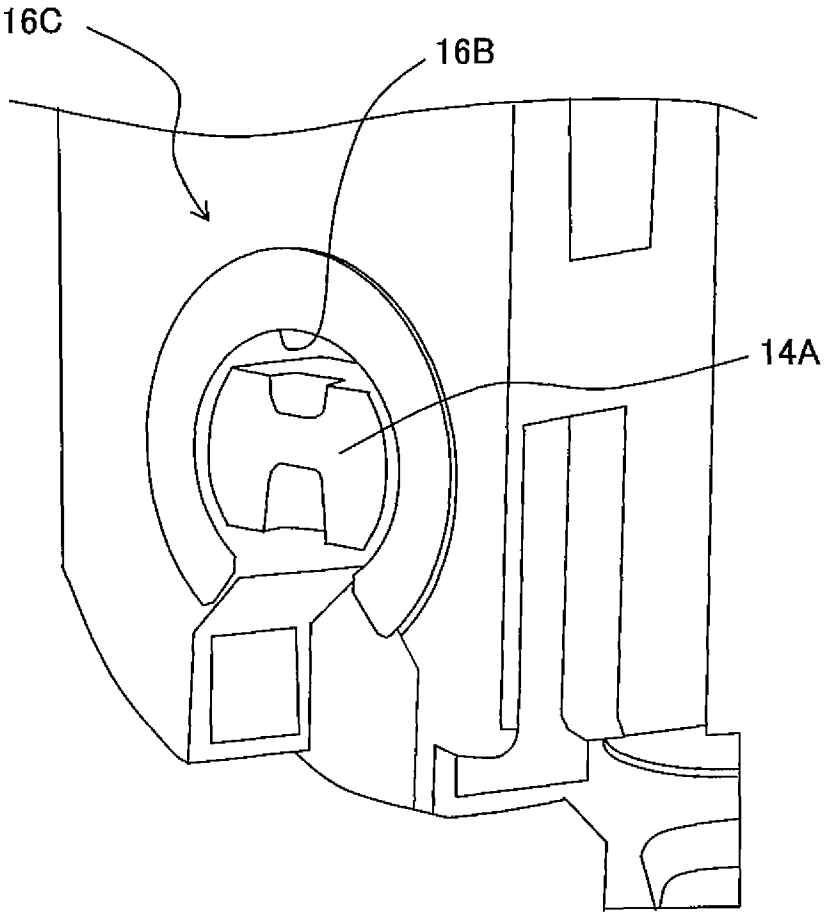
FIG. 13 is an enlarged schematic view depicting a boss 14A and a through hole 16B.

As depicted in FIG. 12, a leg portion 16A extending toward the connecting shaft 151 is provided with the casing 16, and a through hole 16B is formed in one end 16C of the leg portion 16A. The one end 16C of the leg portion faces the second gear holder 149. As depicted in FIG. 13, a boss 14A extending from the casing 14 is fitted into the through hole 16B. Further, as depicted in FIG. 12, the connecting shaft 151 is also fitted into the through hole 16B. The bypass tray 71 is configured to rotate with the casing 16 as a unit. Therefore, under ordinary circumstances, it is required that a rotational center of the casing 16 coincides with the connecting shaft 151. However, in the present embodiment, the first gear holder 141 is a little rotatable with respect to the casing 14. Therefore, when the casing 16 is opened, the connecting shaft 151 is moved a little in a normal direction perpendicular to the connecting shaft 151. If the diameter of the connecting shaft 151 is same as the diameter of the through hole 16B, it is not possible to allow the movement of the connecting shaft 151. Accordingly, the diameter of the through hole 16B is formed to be a little greater than the diameter of the connecting shaft 151 to allow the movement of the connecting shaft 151.

As depicted in FIG. 12, the casing 16 is swung about the same axis line as the connecting shaft 151 with respect to the casing 14. Along with the swinging of the casing 16, the fixed portion 185 of the bypass tray 71 fixed on the casing 16 also swings about the connecting shaft 151, and the gear 146 swings around the gear 144 supported by the connecting shaft 151. Further, when the casing 16 is swung, the first gear holder 141 does not swing with respect to the casing 14 and, also, the second gear holder 149 does not swing with respect to the bypass tray 71. The gear 146 is in connection with the torque limiter 127, the feed rollers 75 and the swing member 30, while the torque limiter 127, the feed rollers 75, and the swing member 30 are also caused to swing about the connecting shaft 151 by the swinging of the fixed portion 185 of the bypass tray 71 along with the swinging of the casing 16. As a result, when the gear 146 swings around the gear 144, then the gear 146 rotates the gear 144. The rotation of the gear 144 is transmitted to the gear 136 provided on first conveyance roller 60 via the first drive force transmission portion 35 and the drive force transmission portion 32 on the main body side, but the rotation of the gear 136 is not transmitted to the first conveyance roller 60 due to the backlash of the key groove 137 for the key 138.

Effects of the Embodiment

The first gear holder 141 keeps the constant pitches of the gears 142, 143 and 144 while the second gear holder 149 keeps the constant pitch of the gears 144 and 146. Further, the first gear holder 141 and the second gear holder 149 are swingably connected with each other by the connecting shaft 151 supporting the gear 144. By virtue of this, even when at least one of the first gear holder 141 and the second gear holder 149 swings, the pitches between the gears 143, 144 and 146 are still kept constant.

Even when the bypass tray 71 is swung with respect to the casing 14 of the printer portion 11 so as to rotate the gear 136, because there is the backlash between the key groove 137 and the key 138 between the gear 136 and the first conveyance roller 60, the rotation of the gear 136 is not transmitted to the first conveyance roller 60. By virtue of this, the first conveyance roller 60 is prevented from rotation by the bypass tray 71 swinging together with the casing 16.

<Modifications>

In the embodiment described above, in the feed apparatus 70, the drive force is transmitted from the motor 78 to the moving member 64 and the feed roller 75. However, the equipped unit equipped in the multifunction peripheral 10 is not limited to the feed apparatus 70, and the drive portion in the equipped unit is not limited to the moving member 64 and feed roller 75. Therefore, for example, the equipped unit may be a scanner, while the drive portion may be an automatic document feeder (ADF).

Further, the number of gears and the like may be changed as appropriate for the drive force transmission portion 32 on the main body side, the first drive force transmission portion 35, the second drive force transmission portion 36, and the third drive force transmission portion 37.

In the embodiment described above, the boss 14A is formed in the casing 14 and the through hole 16B is formed in the casing 16. However, the present teaching is not limited to such a configuration. The boss may be formed in the casing 16 and the through hole may be formed in the casing 14. In this case, the connecting shaft 151 may be fitted into the through hole formed in the casing 14. The hole formed in the casing 14 or the casing 16 may be a bottomed hole.

Further, the conveyance apparatus is not limited to the printer portion 11 but may be realized as a scanner adapted to transport recording sheets and carry out image reading.

What is claimed is:

1. A drive force transmission apparatus comprising:

a main body including a drive source;

an equipped unit being equipped to the main body and including a drive portion to which a drive force is transmitted from the drive source in the main body;

a first gear provided in the main body and rotated by the drive force transmitted thereto from the drive source;

a first gear holder provided in the main body to support the first gear;

a second gear provided in the equipped unit to transmit the drive force to the drive portion;

a second gear holder provided in the equipped unit to support the second gear;

a third gear supported by a connecting shaft connecting the first gear holder and the second gear holder to engage respectively with the first gear and the second gear.

2. The drive force transmission apparatus according to claim 1, wherein the first gear holder is provided swingably in the main body, and wherein the second gear holder is provided swingably in the equipped unit.

3. The drive force transmission apparatus according to claim 1, wherein the main body includes a conveyance portion configured to convey a sheet, and wherein the drive force is transmitted from the drive source to the conveyance portion.

4. The drive force transmission apparatus according to claim 3, wherein the equipped unit is configured to be swingable with respect to the main body at a first swinging position and a second swinging position;

wherein the conveyance portion includes a conveyance roller;

wherein the drive force transmission further comprises a fourth gear to which the drive force is transmitted from the drive source, which is configured to transmit the drive force to the first gear, and which is coaxially coupled to a rotational axis of the conveyance roller such that the fourth gear is embedded into the rotational axis so that a backlash is created between the fourth gear and the rotational axis in a rotational direction of the conveyance roller.

5. The drive force transmission apparatus according to claim 3, wherein the drive portion includes a feed roller configured to feed the sheets to the conveyance portion in the main body.

6. The drive force transmission apparatus according to claim 3, wherein when the equipped unit swings between the first swinging position and the second swinging position, the first gear holder is configured not to swing with respect to the main body and the second gear holder is configured not to swing with respect to the equipped unit.

7. An image recording apparatus comprising:

the drive force transmission apparatus according to claim 3; and a recording portion configured to record images on a sheet conveyed by the conveyance portion of the drive force transmission apparatus.

8. The image recording apparatus according to claim 7, wherein the equipped unit is a feed apparatus configured to feed the sheets to the conveyance portion; and wherein the drive portion has a feed roller to which the drive force is transmitted from the second gear and which is configured to feed the sheets to the conveyance portion.

9. The image recording apparatus according to claim 8, wherein the feed apparatus includes a bypass tray configured to swing between a first swinging position upstanding in parallel with a lateral surface of the main body, and a second swinging position that is inclined to the lateral surface of the main body;

wherein the bypass tray is configured to be stackable with the sheets in a case that the bypass tray is located at the second swinging position; and the feed roller is configured to feed the sheets, that are stacked on the bypass tray at the second swinging position, to the conveyance portion.

10. The image recording apparatus according to claim 7, wherein a hole is formed in one of the main body and the equipped unit, and a boss is formed in the other of the main body and the equipped unit, wherein the equipped unit is configured to be swingable about the hole, wherein the connecting shaft is fitted into the hole, and wherein a diameter of the hole is greater than a diameter of the connecting shaft.

11. The image recording apparatus according to claim 10, wherein the equipped unit includes a connecting portion connected to the main unit and a facing portion facing the second gear holder, wherein the connecting portion and the facing portion are configured to sandwich the second gear holder therebetween, wherein the hole is formed as a through hole in the facing portion, a diameter of the through hole being greater than the diameter of the connecting shaft, and wherein the connecting shaft is arranged to pass through the through hole.

* * * * *